United States Patent [19]

Ferch

[11] 4,047,735

[45] Sept. 13, 1977

[54] SKI HAVING A PATTERNED TOP COVERING

[75] Inventor: Rudolf Ferch, Salzburg, Austria

[73] Assignee: Fischer Gesellschaft m.b.H., Ried im Innkreis, Austria

[21] Appl. No.: 693,794

[22] Filed: June 8, 1976

[30] Foreign Application Priority Data

June 12, 1975 Austria ..... 4522/75

[51] Int. Cl.[2] ..... A63C 11/14

[52] U.S. Cl. ..... 280/610; 280/11.37 E; 428/54

[58] Field of Search ..... 280/610, 601, 602, 11.37 E; 428/53, 54, 55, 56; 40/125 A

[56] References Cited

U.S. PATENT DOCUMENTS

| | | | |
|---|---|---|---|
| 3,520,546 | 7/1970 | Joseph | 280/601 |
| 3,567,237 | 2/1971 | Miller III | 280/610 |
| 3,704,023 | 11/1972 | Downs | 280/610 |
| 3,980,312 | 9/1976 | Buttner | 280/11.37 E |

FOREIGN PATENT DOCUMENTS

| | | | |
|---|---|---|---|
| 1,518,341 | 3/1968 | France | 280/601 |

*Primary Examiner*—Philip Goodman
*Assistant Examiner*—David M. Mitchell
*Attorney, Agent, or Firm*—Imirie & Smiley

[57] ABSTRACT

A ski having a top covering which consists of successive complementary plastic material sheeting sections, which are colored throughout in different colors.

1 Claim, 1 Drawing Figure

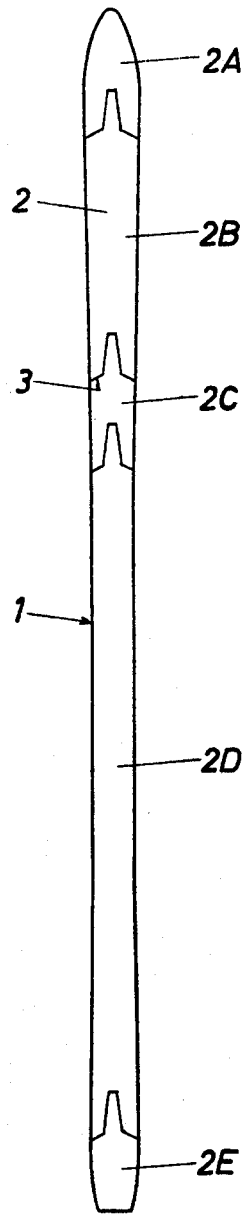
2A
2
2B
3
2C
1
2D
2E

SKI HAVING A PATTERNED TOP COVERING

SUMMARY OF THE INVENTION

The present invention relates to a patterned top covering of skis in which stamped sections of plastic materials in different colors are applied to the ski successively in the longitudinal direction of the ski, closely adjoin each other and are adhered to the underlying layer.

In sandwich-type laminated skis having top facings consisting of metal or fiber-reinforced plastic material, it is known to protect the top facing by a covering which either is formed by painting a solution of a covering composition on the ski or consists of a plate or strip which has been secured by adhesive to the top facing. Painted coverings have the disadvantage that they are very thin and have only a low scratch resistance so that deep scratches may be formed in the top covering particularly when the skis are often crossed by unskilled skiers. Such scratches do not only mar the appearance of the ski but promote also the formation of small grooves or cuts, at which the painted composition may often begin to chip off. Whereas covering plates have a higher strength, the previously used covering plates consisting of strips which extend throughout the length of the ski had the disadvantage of being uniform in color so that a pattern could be provided on the ski only by screen printing; although a screen-printed pattern has an inadequate scratch resistance, like a painted composition. Other methods of providing patterns on the top surface of the ski by etching etc. are not satisfactory because they involve high costs.

It has also been proposed to provide structural composite plates as top facings or tread facings in which the transmission of stresses is interrupted at parting lines between the structural plates so that the stresses in the plate material will not distort the ski. These parting lines generally are not effective however, if the composite facings are firmly adhered to the ski throughout their surface. Thus, the use of composite facings does not provide a solution to the above problem of providing the ski with a finish which is decorative.

To solve the problem set forth and to avoid the disadvantages of the known top coverings it is proposed to provide a ski, which is of the kind defined first hereinbefore in accordance with the invention, with stamped sections of plastic material in different colors, which sections are successively arranged in the longitudinal direction of the ski and closely adjoin each other and are adhered to the underlying layer.

Plastic material sheeting sections which are colored throughout and adjoin at identical parting lines provide a top covering which has an excellent wear resistance, particularly if the sections have a substantial thickness, which is desirably between 0.5 and 1.2 mm whereas conventional screen-printed coverings have in most cases a thickness below 0.1 mm. The use of parting lines which are transverse to the longitudinal direction of the ski and of the strip of plastic material and have the same configuration permits the sections to be cut from a roll and enables the use of different colors in any desired pattern. This is a great advantage over the use of inlaid pieces, such as is known in furniture.

Further details of the invention will be explained more fully with reference to the drawing, which is a top plan view showing by way of example a ski which is provided with the top covering according to the invention.

DETAILED DESCRIPTION OF THE INVENTION

A ski 1 has a top covering 2, which consists in the present case of five sections 2A to 2E, which have mating, interengaging edges and have been stamped from plate, strip or the like material. The parting lines 3 between adjacent sections may be identical or different. In the simplest case the parting lines are straight and at right angles or oblique to the longitudinal direction of the ski. The parting lines have preferably a configuration such that adjoining sections 2A to 2E of the top covering have mating, interengaging edge portions.

The sections 2A to 2E of the top covering are joined to the body of the ski or a top facing of such body in a manner which is conventional with covering plates, e.g., by adhesive.

In that connection the term covering plates is used in its widest meaning and includes any sheet material which can be cut or stamped. In general, plastic material sheeting is used which has a thickness of an order of about 0.3 to 1.5 millimeters.

What is claimed is:

1. In combination with a snow ski having a lower running surface and a smooth upper surface, the improvement comprising a patterned top covering comprised of plural elongated sheets of plastic material having a thickness of about 0.3 to 1.5 millimeters, said plural sheets being colored throughout in different colors and arranged in succession longitudinally of said ski, adjacent sheets having mating edges such that said sheets are disposed in direct juxtaposition with each other throughout the length of the ski, and means for adhering said sheets to said upper surface of said ski.

* * * * *